United States Patent [19]

Meier, Jr.

[11] Patent Number: 4,850,110

[45] Date of Patent: Jul. 25, 1989

[54] SCISSORS WITH HAIR HOLDING CLAMP

[76] Inventor: Richard R. Meier, Jr., 900 W. Blue Starr #7, Claremore, Okla. 74017

[21] Appl. No.: 251,555

[22] Filed: Sep. 29, 1988

[51] Int. Cl.[4] ..... B26B 13/24

[52] U.S. Cl. ..... 30/135; 30/195; 30/233

[58] Field of Search ..... 30/134, 135, 195, 233, 30/233.5, 254, 255, 256, 257, 258, 259, 260, 261, 262

[56] References Cited

U.S. PATENT DOCUMENTS

| | | | |
|---|---|---|---|
| 169,832 | 11/1875 | Nickelson . | |
| 395,444 | 1/1889 | Klein . | |
| 473,710 | 4/1892 | Rimmelin . | |
| 835,791 | 11/1906 | Kelly | 30/135 |
| 1,004,404 | 9/1911 | Fordyce . | |
| 1,294,998 | 2/1919 | Billy . | |
| 1,430,512 | 9/1922 | Langlais . | |
| 1,901,739 | 3/1933 | Engel | 30/261 X |
| 1,918,700 | 7/1933 | Harris | 30/134 X |
| 2,629,171 | 2/1953 | Boegehold | 30/233.5 |
| 2,721,385 | 10/1955 | Ames | 30/233.5 |
| 3,456,345 | 7/1969 | Tuck | 30/233.5 |
| 3,914,866 | 10/1975 | Applegate | 30/233.5 |

*Primary Examiner*—Frank T. Yost
*Assistant Examiner*—Michael D. Folkerts
*Attorney, Agent, or Firm*—Head & Johnson

[57] ABSTRACT

A pair of cutting scissors is modified to clamp the hair at a particular length so that it can be cut as desired. One of the blades of a pair of scissors is provided with a elongated pad along one side adjacent the cutting edge. A clamp blade is pivotally attached to such blade near its pivot with the other cutting blade. The clamp blade can rotate about the pivot to be in engagement with the clamping pad. Biasing means urges the clamp blade into an opened position. A pivot lever, operable by the index finger, is provided to force the clamp blade into a closed position.

6 Claims, 2 Drawing Sheets

SCISSORS WITH HAIR HOLDING CLAMP

DISCLOSURE STATEMENT

A preliminary patentability search revealed the patents which are listed on the attached form PTO-1449, copies of which are enclosed. Several of these patents, including the patent to Billy, Langlais, Rimmelin, Tuck and Boegehold show attaching a comb to a pair of scissors. However, none of these patents has a clamping means associated with one of the blades of the scissors for holding the hair in place so that the two blades of the scissors can cut it in the exact position in accordance with how it is being held by the clamping means.

BACKGROUND OF THE INVENTION

This invention relates to scissors used for cutting hair, and especially for scissors including means for cutting hair to a selected length.

Barbers, hairstylists and cosmetologists have been cutting hair for ages with scissors. The hair has to be cut to the proper length at different locations about the scalp in order to obtain the desired effect. In order to accomplish this it has been the frequent practice to hold the hair between the fingers and then cut off the top with a pair of scissors. There are many scars formed on the freehand when it is used to clamp the hair between the first three fingers, pull to length and then cut the protruding hair between the two fingers. A frequent practice is to use a comb to bring the hair to an upright position and grasp the hair between the comb teeth between the first and second fingers of the left hand, dispose of the comb and then cut the tops off the hairs that show between the fingers. In some cases the comb may be attached to the blade of the scissors such as in U.S. Pat. No. 3,914,866 to Applegate. There the finger of the hand is still required to hold the hair in place when cutting it.

It is thus an object of this invention to provide modified scissors whereby hair can be cut at a selected length without holding it by use of comb or fingers.

SUMMARY

Hair trimming scissors are modified to provide means for holding hair in a select position along one of the cutting blades so that it may be cut at the desired length. A clamping base strip is secured along the side of one of the cutting blades and adjacent the cutting edge. A clamping lever is pivotally attached to the blade having the clamping base strip attached thereto. The clamping lever has an activating handle which is on the side of the pivot toward the handle of the cutting blade.

The clamping lever is biased about the pivot so that it is normally in an open position, i.e., away from the clamping base strip. However, by applying force against the actuating handle the clamping lever can be forced against the clamping base strip. This is accomplished by an actuating lever which is pivotally attached to the cutting blade which supports the clamping base strip.

In operation, hair is placed across the clamping base strip so that the desired length will be held in proper position when clamped. Then the actuating lever is activated by the index finger of the barber. This forces the clamping lever against the clamping base strip and holds the hair in proper position. Then the scissors are operated to cut the hair which will be cut at a length in accordance with where the hair was grasped by the clamping base strip and the clamping lever. When the cut is made, the index fingers relieve the force on the actuating lever and the clamping lever rotates to an open position to be ready for the next cut. If the clamping feature is not desired for a series of cuts, it can be locked in its clamped or closed position and the device used as a regular pair of scissors.

DETAILED DESCRIPTION

Figure 1:
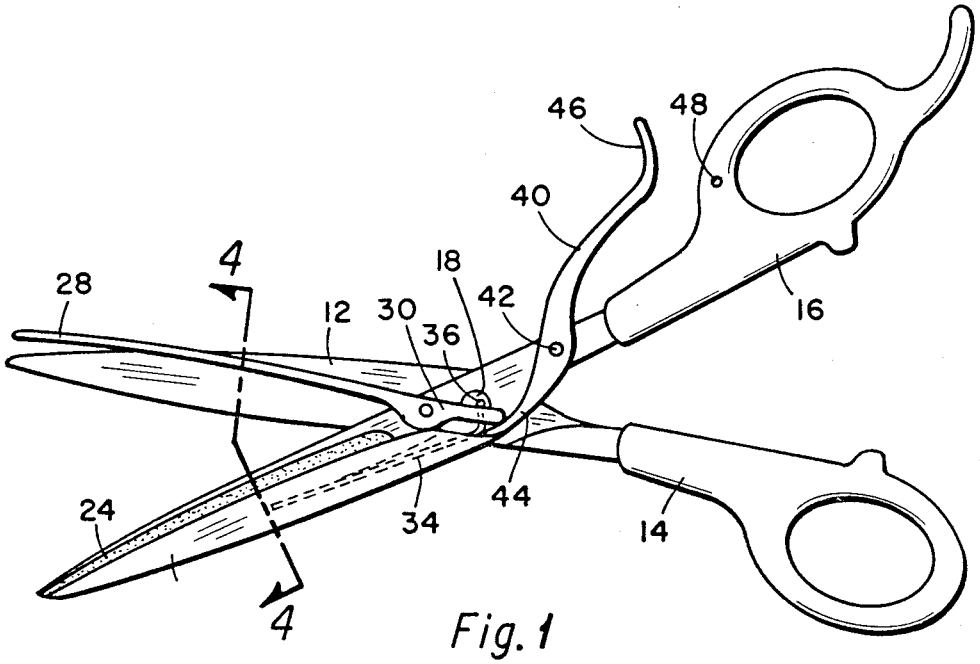
FIG. 1 is a plan view showing the improved scissors of my invention with the clamping lever and the scissor cutting blades in an open position.

Attention is first directed to FIG. 1 which shows a pair of scissors featuring my invention. Shown thereon is a first cutting blade 10, with handle 16 and a second cutting blade 12 having handle 14. the two cutting blades are held together by a pivot bolt 18. A clamping strip is provided along the edge of cutting blade 10 and may include a plastic base 22 and a foam pad 24. The positioning of this can be clearly seen in FIG. 4. The foam would preferably be some plastic foam which is rather firm with some resilience. Cutting blade 10 is also provided with a clamping lever 28 having handle 30 and pivotally attached at pivot 32 to cutting blade 10.

As shown in FIG. 1 clamping lever 28 is biased to an open position. In the embodiment shown in FIG. 1 this is accomplished by a leaf spring 34 which has an upper extension 36 which extends over handle 30 of the clamping lever 28. This spring then forces the handle 30 above pivot 32 to urge the clamping lever 28 into the open position shown in FIG. 1.

Also shown in FIG. 1 is a lever actuator 40 which is pivotally attached at 42 to handle 16. A tongue 44 is provided actuating lever 40 and extends under the end of clamping blade handle 30. The barber's index finger will fit into curved space 46 and by pushing down on it toward the handle 16, the tongue 44 will cause the clamping lever 28 to assume the position shown in FIG. 2. Sometimes it may be desired to lock the clamping lever in the position shown in FIG. 2 and use the scissors shown as one would use ordinary scissors. This locking can be effected by pressing a lock pin into hole 48 in handle 16. This then would hold the clamping lever 28 in the position shown in FIG. 2. Alternatively, a hook, such as used in common garden shears, can be used to hold the clamping lever in the closed position.

Figure 2:
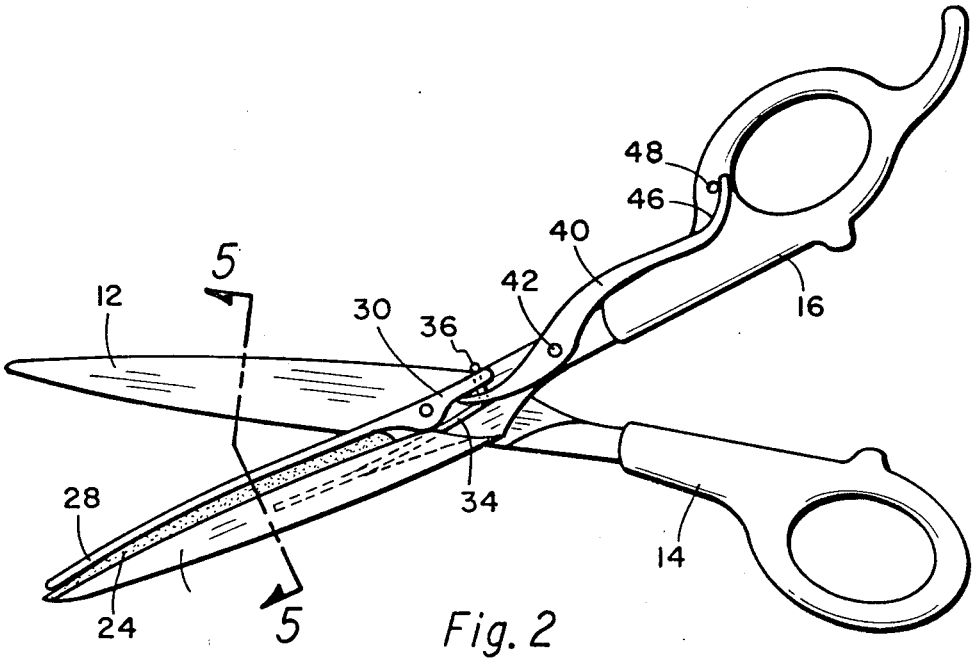
FIG. 2 is similar to FIG. 1 except that the clamping lever is in a clamped position such that it would be in when holding hair in position.
Figure 3:
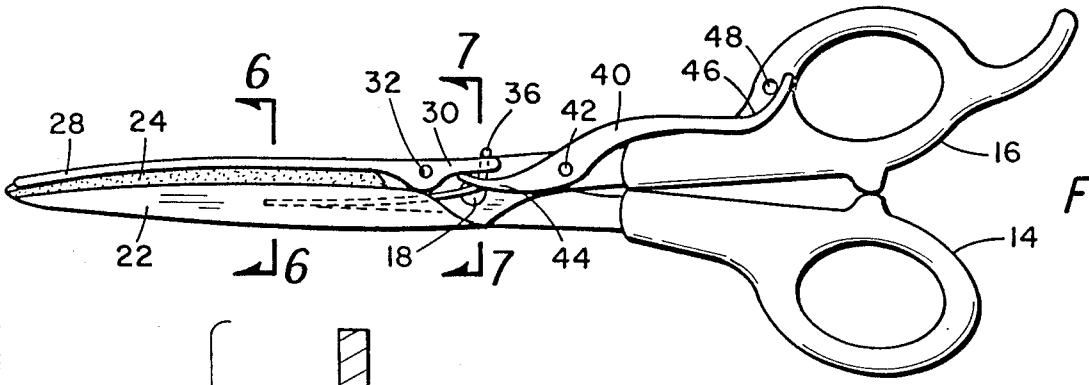
FIG. 3 is a full face view of the improved scissors of my invention with the clamping lever and the cutting blades both in a closed position.
Figure 7:
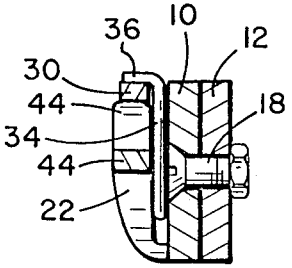
FIG. 7 is a view taken along the line 7—7 of FIG. 3.

FIG. 3 is similar to FIG. 2 except that the scissors have been operated so that the cutting blades 10 and 12 and the clamping lever are all in a closed position.

Figure 6:
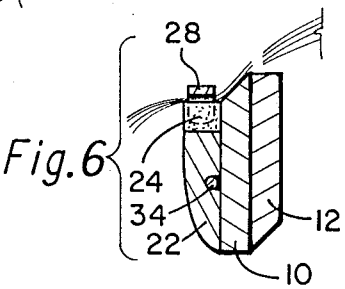
FIG. 6 is a view taken along the line 6—6 of FIG. 3.
Figure 5:
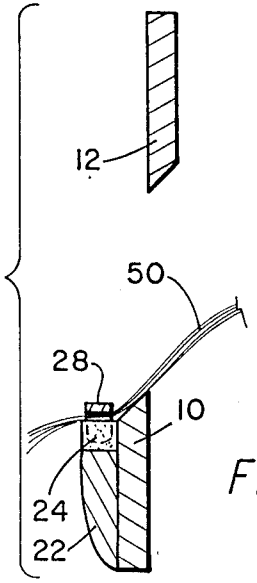
FIG. 5 is a view taken along the line 5—5 of FIG. 2.
Figure 4:
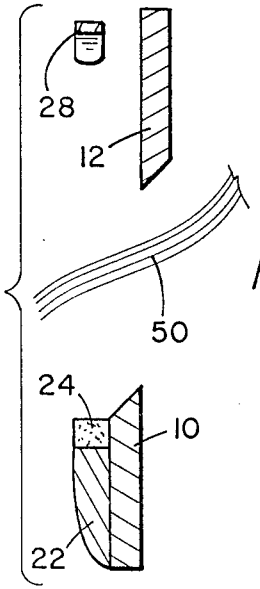
FIG. 4 is a view taken along the line 4—4 of FIG. 1.

In operation, as illustrated in FIGS. 4 and 5, hair 50 is brought across cutting blade 10 and foam strip 24. This can be accomplished while the device is in the position shown in FIG. 1. As soon as the proper length of hair is protruding across the foam strip 24, the clamping lever 28 is activated by the operator pulling down on lever actuator 40 with the index finger in curved portion 46. This causes the clamp lever 28 to assume the position shown in FIGS. 2 and 5. Once the hair is properly positioned and clamped, the scissors of my invention would be used like ordinary scissors to cut the hair. The cut position is like that shown in FIGS. 3 and 6 with the hair being cut between the blades 10 and 12.

It is thus seen that I do not hold the hair between my fingers or between a comb. With my invention I merely grasp the hair, then I pull the cutting device clamping the hair to the desired length of hair and then I clamp it with the clamping lever 28. I now have the hair in the proper position, or if clamped shorter than desired cutting position, I will lift the scissor clamping the hair away from the scalp until the desired length is attained. All that I need to do is to cut the hair with the scissors using cutting blades 10 and 12 in the ordinary manner. With this invention there are no scars formed on the free hand which in prior methods was used to clamp the hair between the first two fingers and pull the proper length and cut the protruding hair between the fingers. Operation of my device is simple. I use the index fingers to operate the spring loaded clamping lever to clamp the hair across the cutting edge and when it is clamped, the normal operation of the scissors is easily accomplished.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A new scissor for cutting hair which comprises:

a first element having a first cutting blade and a first handle;

a second cutting element having a second cutting blade and a second handle;

first pivot means connecting said first element and said second element so that said first and second cutting blades may cut;

a clamping element comprising a clamping lever and a clamping lever handle;

a clamping base strip extending along said first cutting blade adjacent the cutting edge thereof;

second pivot means pivotally connecting said clamping element to said first cutting blade such that said clamping element is revolvable about said second pivot so that said clamping lever may contact said clamping base strip in one position and be revolved in the other direction to an open position;

means to move said clamping lever between its closed position against said clamping base strip and said open position.

2. A scissor as defined in claim 1 in which said means to move said clamping lever includes a lever actuator, a pivot attaching said lever actuator to said first handle, said lever actuator having a tongue which contacts the clamping lever handle to force said clamping lever into a closed position, and a spring supported by said first cutting blade urging said clamping lever to rotate about said second pivot to an open position.

3. A scissor as defined in claim 1 including a locking means to lock said lever actuator in a position to hold said clamping lever against said clamping base strip.

4. An apparatus for cutting hair which comprises:

a first cutting blade having a side and a cutting edge;

a second cutting blade;

a first pivot means for connecting said first and second cutting blades together;

a clamping strip secured to one side of said first cutting blade next to the edge thereof;

a clamping lever pivotally attached by a second pivot to said first cutting blade and rotatable between a first position where the clamping lever lies along said clamping strip and a second position in which the clamping lever rotates about said second pivot to an open position;

means to actuate the movement of said clamping lever about said second pivot.

5. An apparatus as defined in claim 4 including biasing means to bias said clamping lever to an open position.

6. An apparatus as defined in claim 5 including means to lock said clamping lever against said clamping strip.

* * * * *